US007148629B2

(12) United States Patent
Ha et al.

(10) Patent No.: US 7,148,629 B2
(45) Date of Patent: Dec. 12, 2006

(54) AGING CIRCUIT FOR ORGANIC ELECTRO LUMINESCENCE DEVICE AND DRIVING METHOD THEREOF

(75) Inventors: Yong Min Ha, Kyoungsangbuk-do (KR); Chang Yeon Kim, Seoul (KR); Sang Soo Han, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 10/606,768

(22) Filed: Jun. 27, 2003

(65) Prior Publication Data

US 2004/0051469 A1 Mar. 18, 2004

(30) Foreign Application Priority Data

Aug. 27, 2002 (KR) ..... 10-2002-0050880

(51) Int. Cl.
*G09G 3/10* (2006.01)

(52) U.S. Cl. ..... 315/169.3; 345/76; 345/82

(58) Field of Classification Search ... 315/169.1–169.3, 315/1, 169.4, 291, 224; 345/211–212, 46, 345/72, 76, 80, 82, 204, 140; 257/59, 88, 257/72

See application file for complete search history.

(56) References Cited

U.S. PATENT DOCUMENTS

| | | | | |
|---|---|---|---|---|
| 6,501,230 | B1 * | 12/2002 | Feldman | 315/169.3 |
| 6,525,683 | B1 * | 2/2003 | Gu | 341/140 |
| 6,683,417 | B1 * | 1/2004 | Lee et al. | 315/169.3 |
| 6,686,699 | B1 * | 2/2004 | Yumoto | 315/169.3 |
| 6,693,383 | B1 * | 2/2004 | Bae et al. | 315/169.1 |
| 6,693,388 | B1 * | 2/2004 | Oomura | 315/169.3 |
| 6,734,636 | B1 * | 5/2004 | Sanford et al. | 315/169.3 |
| 6,806,497 | B1 * | 10/2004 | Jo | 257/59 |
| 2003/0052904 | A1 * | 3/2003 | Gu | 345/691 |
| 2003/0107565 | A1 * | 6/2003 | Libsch et al. | 345/211 |

FOREIGN PATENT DOCUMENTS

| | | |
|---|---|---|
| JP | 2000-122598 A | 4/2000 |
| JP | 2001-109421 A | 4/2001 |
| WO | WO 9836405 | 8/1998 |

* cited by examiner

*Primary Examiner*—Thuy V. Tran
*Assistant Examiner*—Chuc Tran
(74) *Attorney, Agent, or Firm*—Morgan, Lewis & Bockius, LLP

(57) ABSTRACT

An aging circuit for an organic electro luminescence device includes a plurality of pixels arranged in a matrix at intersection areas of row lines and column lines and an aging circuit having at least one aging AC voltage source to apply a specific aging AC voltage pulse to the pixels.

16 Claims, 6 Drawing Sheets

AGING CIRCUIT FOR ORGANIC ELECTRO LUMINESCENCE DEVICE AND DRIVING METHOD THEREOF

This application claims the benefit of the Korean Patent Application No. P02-050880 filed on Aug. 27, 2002, which is hereby incorporated by reference.

BACKGROUND OF THE INVENTION

1. Field of the Invention

The present invention relates to an electro luminescence device, and more particularly to an aging circuit for an organic electro luminescence device to prevent the deterioration of the electro luminescence device, and a driving method thereof.

2. Description of the Related Art

Recently, there has been developed various flat panel displays, which have the advantages of reduced weight and reduced bulk over a Cathode Ray Tube (CRT). Such flat panel displays include a Liquid Crystal Display (LCD), a Field Emission Display (FED), a Plasma Display Panel (PDP), and Electro Luminescence (hereinafter, EL) display device.

The structure and fabricating process of the PDP are relatively simple compared to the LCD, FED and EL devices. Another advantage of the PDP is that it can be made to have a large size but yet be light weigh. However, the light emission efficiency and brightness of a PDP is low while its power consumption is high.

Compared to a PDP, an LCD is difficult to make because of the semiconductor process for making the Thin Film Transistor (TFT), which is used as a switching device in each of the pixels in the LCD. The demand for LCDs has been increasing with the increasing demand of notebook computers because it is typically used as the display device of a notebook computer. However, the LCD has a disadvantage in that power consumption is high because the LCD uses a backlight unit. Further, the LCD also has the disadvantage of high light loss caused by the use of optical devices, such as a polarizing filter, a prism sheet, a diffusion panel. Another disadvantage of the LCD is a narrow viewing angle.

EL display devices are generally classified as either an inorganic EL device or an organic EL device depending on the material of a light-emission layer of the EL display device. Since an EL device is a self-luminous device, it has the advantages of a fast response speed, a high light-emission efficiency and high brightness. In addition, an EL device has the advantage of a wide viewing angle.

FIG. 1 is a sectional view representing an electro luminescence display device of the related art. As shown in FIG. 1, the organic EL display device includes a hole injection layer 3, a light emission layer 4, an electron injection layer 5 deposited between a cathode 6 and an anode 2 formed of a transparent electrode on a substrate 1. If a drive voltage is applied across the anode 2 and the cathode 6 in the organic EL display device, holes in the hole injection layer 3 and electrons in the electron injection layer 5 move into the light emission layer 4 and excite a fluorescent material within the light emission layer 4. Accordingly, a picture or an image is displayed by the visible light generated from the light emission layer 4 when a plurality of EL display devices are used together in an active matrix EL display panel.

In the organic EL device, a small-molecule organic EL material can be patterned by a vacuum deposition. In the alternative, a high polymer organic EL material can be patterned by a coating method using an inkjet spray head or a printing system. Construction of a high polymer organic EL will be explained in conjunction with FIG. 2.

FIG. 2 is a schematic plan view representing a pixel arrangement of an organic electro luminescence device of the related art. FIG. 3 is an equivalent circuit diagram of a pixel shown in FIG. 2. Referring to FIGS. 2 and 3, the organic electro luminescence device includes a number m of column lines CL1 to CLm, a number n of row lines RL1 to RLn to cross the column lines CL1 to CLm, and a number m×n of pixels P arranged in a matrix between the row lines and data lines.

Each pixel P of the organic electro luminescence device includes a first TFT T1 acting as a switching device formed at each intersection of the column lines CL1 to CLm and the row lines RL1 to RLn and a second TFT T2 formed between a cell drive voltage source VDD and an electro luminescence cell OLED for driving the electro luminescence cell OLED. The first and second TFT's T1 and T2 are p-type MOSFETs. In addition, a capacitor is connected between the gate of the second TFT T2 and the cell drive voltage source VDD.

The first TFT T1 is turned on in response to a negative scan voltage from the row line RL1 to RLn. Thus a current path is enabled to conduct current between the source terminal and the drain terminal of the first TFT T1. Of course, the first TFT T1 remains in an "off" state when a voltage in the row line RL1 to RLn is below the threshold voltage Vth of TFT T1. A data voltage Vc1 from the column line CL is applied to the gate terminal of the second TFT T2 through the first TFT T1 during the on-time period of the first TFT T1. However, the current path between the source terminal and the drain terminal of the first TFT T1 is blocked during the off-time period of the first TFT T1 such that the data voltage Vc1 is not applied to the second TFT T2.

The second TFT T2 controls the current between the source terminal and the drain terminal in accordance to the data voltage Vc1 applied to its gate terminal. Accordingly, the electro luminescence cell OLED is made to emit light with a brightness corresponding to the data voltage Vc1. The capacitor Cst stores a voltage difference between the data voltage Vc1 and a cell drive voltage VDD to sustain the voltage applied to the gate terminal of the second TFT T2 for one frame period to uniformly sustain the current applied to the electro luminescence cell OLED for one frame period.

FIG. 4 is a waveform diagram representing signals applied to a column line and a row line shown in FIGS. 2 and 3. As shown in FIG. 4, the row lines are sequentially supplied with negative scan pulses SCAN and the column lines are simultaneously supplied with data voltages DATA that are synchronized with the scan pulses SCAN. While a scan pulse SCAN is applied to the gate of the first TFT T1, the data voltage DATA flows through the first TFT T1 to be charged in the capacitor Cst. In matrix array of such devices, the column lines CL are used to input picture signals, such as RGB data, to display a picture.

In the organic electro luminescence device as discussed the above, there is a disadvantage in that the switching performance of the switching transistors TFT T1 and TFT T2 deteriorates over time. In order to prevent such deterioration, an aging circuit is added to the organic electro luminescence device, the aging circuit applies an aging voltage in a reverse direction across transistors TFT T1 and TFT T2 for a set amount of time. In other words, the aging circuit applies voltages with polarities that are opposite to what is typically applied to the transistors TFT T1 and TFT T2.

FIG. 5 represents a pixel of an organic electro luminescence device to which an aging circuit is connected according to the related art. As shown in FIG. 5, the aging circuit 24 according to the related art is connected to the gate terminal and the drain terminal of the first TFT T1 of the pixel 22 of the organic electro luminescence device. The pixel area 22 of the organic electro luminescence device is configured in the same manner as described in FIG. 3, so the description of the pixel area 22 will be omitted with regard to the discussion of FIG. 5.

The aging circuit 24 includes a first aging switch device A1 connected between the first aging voltage source Va1 and the gate terminal of the first TFT T1, a second aging switch device A2 connected between a second aging voltage source Va2 and the source terminal of the first TFT T1, and a third aging voltage source Va3 to turn on the first and second aging switch devices A1 and A2. The aging circuit 24 applies an aging voltage to the electro luminescence cell OLED, wherein the final aging voltage is a drive voltage from the cell drive voltage source VDD. For this, the second TFT T2 must remain at on state while the aging is under way. For the second TFT T2 to be turned on, the second aging switch device A2 and the first TFT T1 must be on, and the first aging switch device A1 must be on for the first TFT T1 to be turned on.

Voltages Va1 and Va2, which are several times higher than the threshold voltages of the first and second TFT's T1 and T2, are sequentially applied to the gate terminals of the first and second TFT's T1 and T2, respectively. For example, if the electro luminescence cell OLED emits light with cell drive voltage source VDD of −15V and a ground voltage source GND of 0V, the third aging voltage source Va3 connected to the gate terminal thereof applies −30V such that the first and second aging switch devices A1 and A2 are turned on, the first aging voltage source Va1 through the first aging switch device A1 applies −25V to the gate terminal of the first TFT T1 such that TFT T1 is turned on, and the second aging voltage source Va2 applies −20V through the second aging switch device A2 and the first TFT T1 to the gate terminal of the second TFT T2 such that TFT T2 is turned on. Accordingly, while the aging process is under way for several minutes to several hours, since a high voltage is applied for a long time, the first and second TFT's T1 and T2 of the organic electro luminescence device deteriorate.

SUMMARY OF THE INVENTION

Accordingly, it is an object of the present invention to provide an aging circuit for an organic electro luminescence device that is adaptive for preventing the organic electro luminescence device from being deteriorated.

Another object of the present invention to provide an aging circuit for an organic electro luminescence device that is adaptive for reducing aging drive time as well as an aging voltage.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other objects of the invention, an aging circuit for an organic electro luminescence device according to an aspect of the present invention includes a plurality of pixels arranged in a matrix at intersection areas of row lines and column lines; and an aging circuit having at least one aging AC voltage source to apply a specific aging AC voltage pulse to the pixels.

In another aspect, a driving method of an aging circuit for an organic electro luminescence device, wherein the aging circuit applies a specific aging voltage to pixels of the organic electro luminescence device, according to another aspect of the present invention includes applying a plurality of aging AC voltages to the pixels, the aging AC voltage is being applied in an AC voltage pulse; and causing an electro luminescence cell within the pixel to emit light by the aging AC voltage in accordance with a current corresponding to a current path formed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Reference will now be made in detail to the preferred embodiments of the present invention, examples of which are illustrated in the accompanying drawings.

Figure 6:
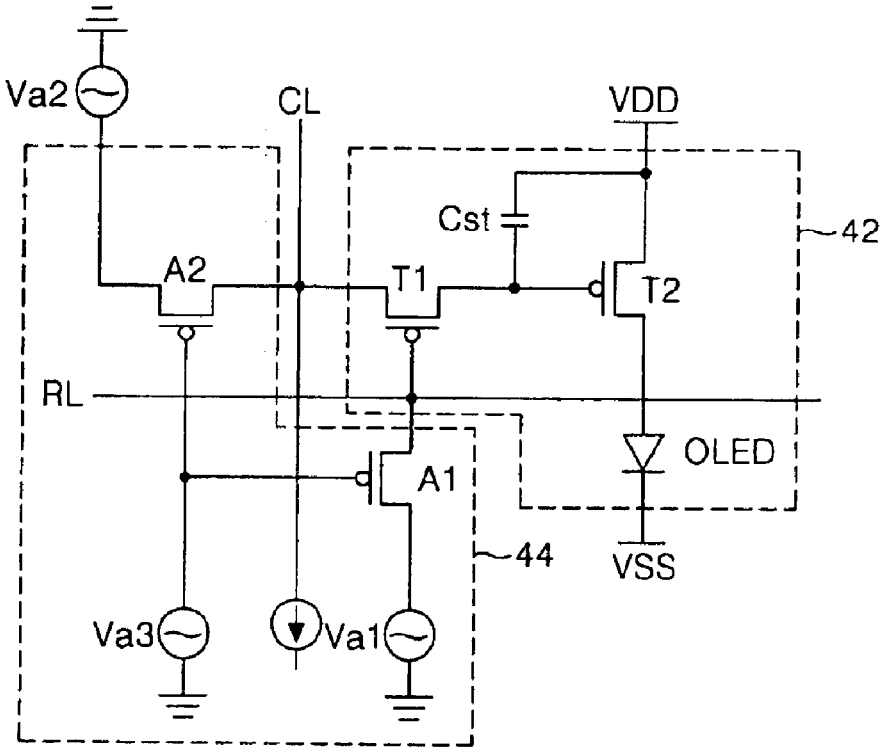
FIG. 6 is a diagram representing an aging circuit for an organic electro luminescence device according to a first embodiment of the present invention.

FIG. 6 is a diagram representing an aging circuit for an organic electro luminescence device according to a first embodiment of the present invention. As shown in FIG. 6, the organic electro luminescence device according to the present embodiment includes a number m of column lines CL1 to CLm, a number n of row lines RL1 to RLn to cross the column lines CL1 to CLm, a number m×n of pixels 42 arranged in a matrix at intersection parts, and an aging circuit 44 enabling the size of the aging voltages and an aging voltage application time to vary, so that aging can be implemented correctly and effectively to improve all characteristics of the organic electro luminescence device, such as the brightness and the deterioration prevention of switch devices.

Figure 1:
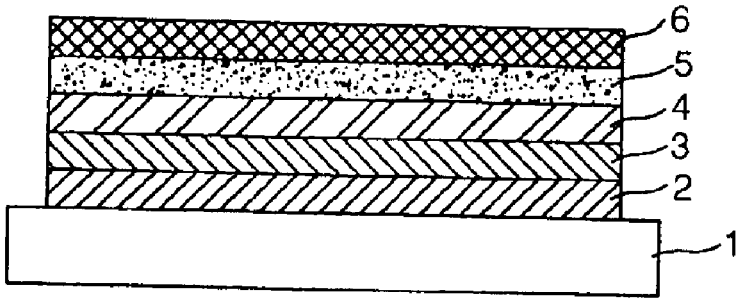
FIG. 1 RELATED ART
FIG. 1 is a schematic sectional view representing a sectional structure of an organic electro luminescence device of the related art.
Figure 3:
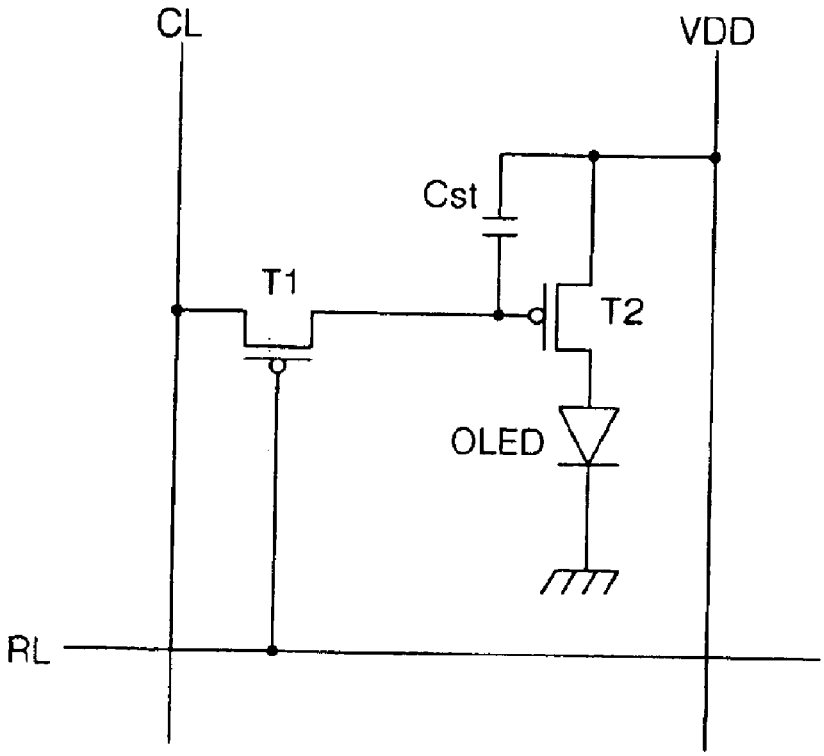
FIG. 3 RELATED ART
FIG. 3 is an equivalent circuit diagram of a pixel shown in FIG. 2.
Figure 2:
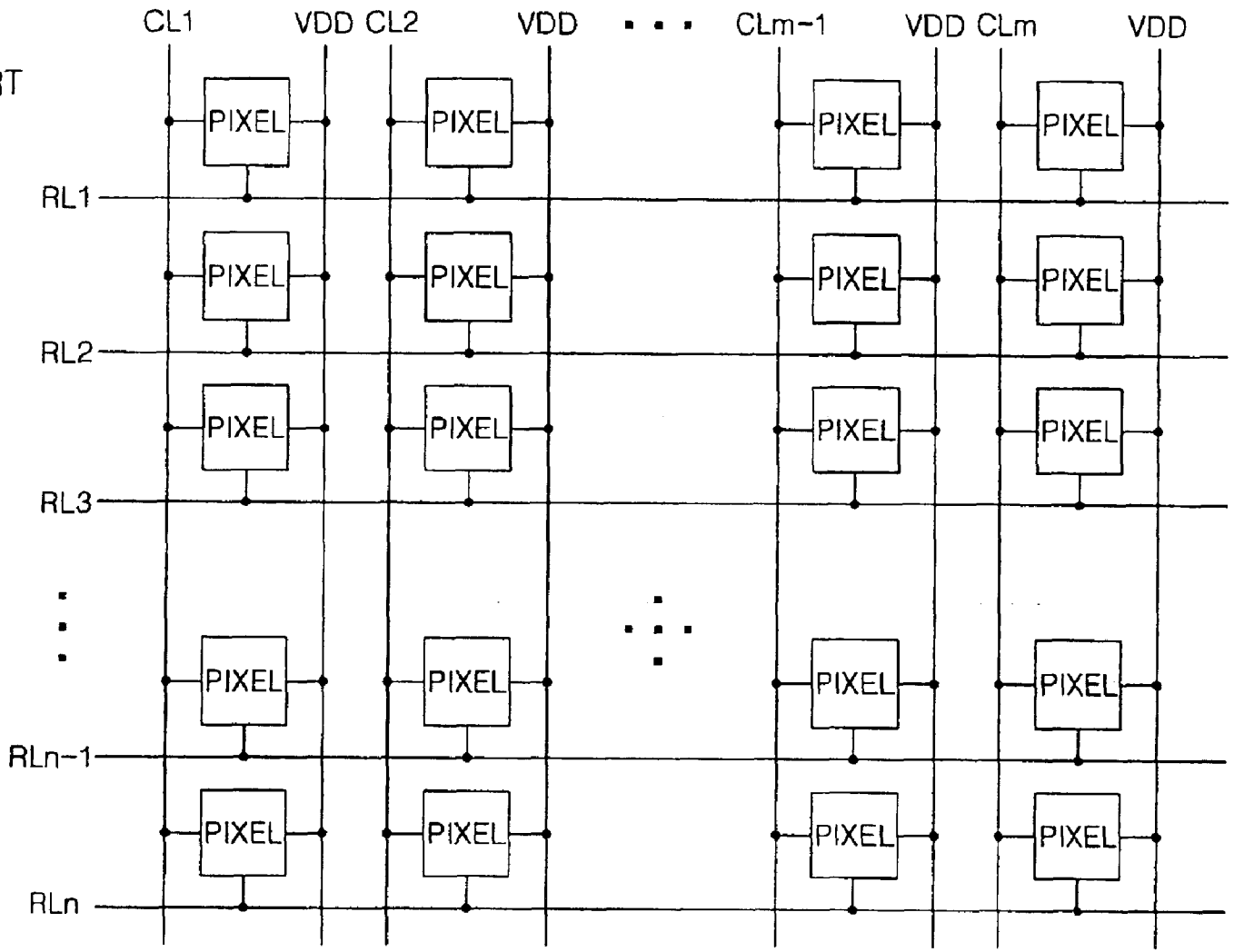
FIG.2 RELATED ART
FIG. 2 is a schematic plan view representing a pixel arrangement of an organic electro luminescence device of the related art.
Figure 4:
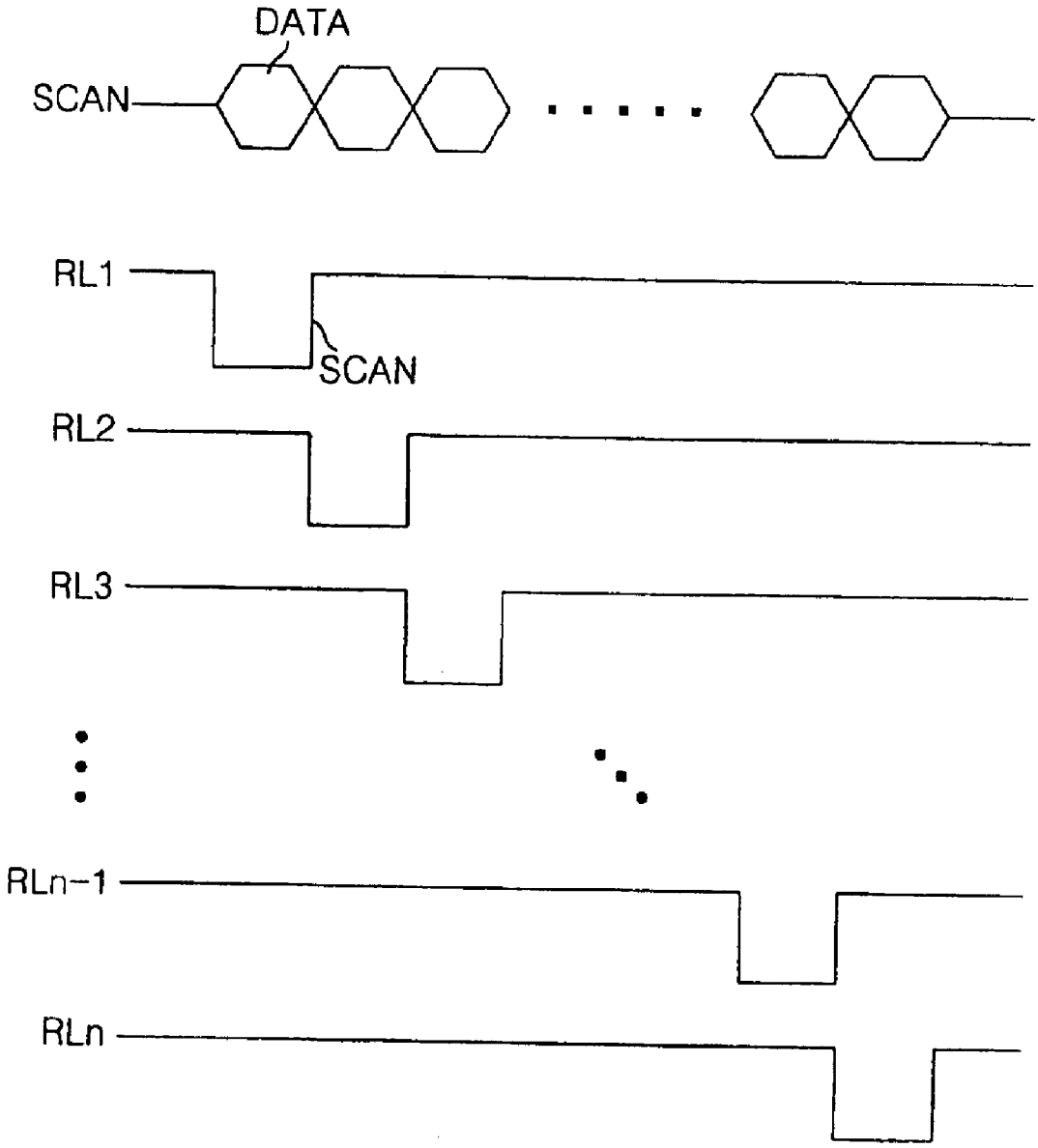
FIG. 4 RELATED ART
FIG. 4 is a waveform diagram representing signals applied to a column line and a row line shown in FIGS. 2 and 3.
Figure 5:
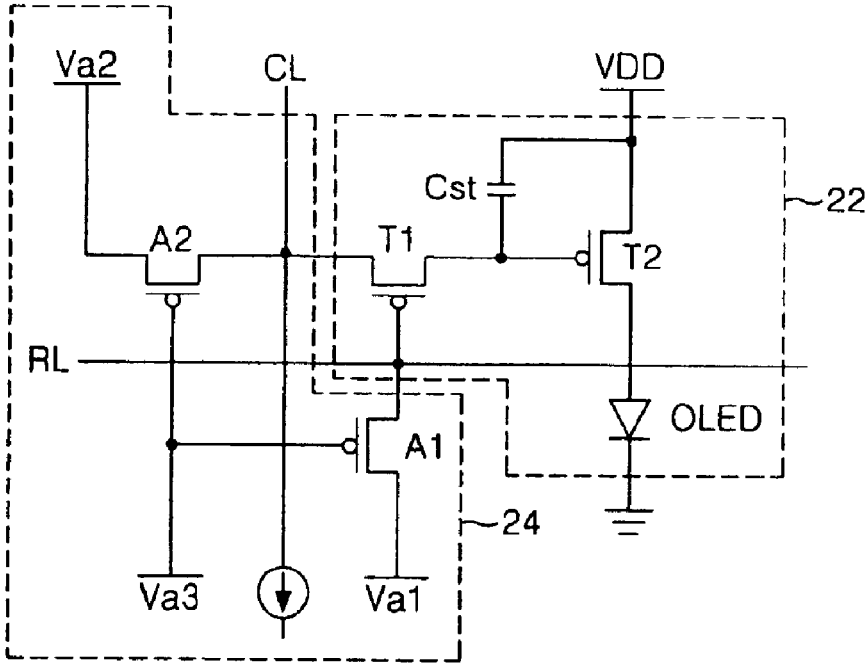
FIG.5 RELATED ART
FIG. 5 is a diagram representing an aging circuit for an organic electro luminescence device according to the related art.

Each pixel 42 includes a first TFT T1 acting as a switching device formed at each intersection part of the column lines CL1 to CLm and the row lines RL1 to RLn, a second TFT T2 formed between a cell drive voltage source VDD and an electro luminescence cell OLED for driving the electro luminescence cell OLED, and a capacitor Cst connected between the cell drive voltage source VDD and the gate of the second TFT T2. The first and second TFT's T1 and T2 are p-type MOS-FET's. The cathode terminal of the electro luminescence cell OLED is supplied with a cell support voltage VSS that has s specific voltage difference with a cell drive voltage VDD. The voltage difference between the cell drive voltage VDD and the cell support voltage VSS can be the same as the voltage difference between the cell drive voltage VDD and the ground voltage GND as shown in the related art of FIG. 3.

The first TFT T1 is turned on in response to a negative scan voltage from the row line RL1 to RLn to enable a current between the source terminal and the drain terminal of the first TFT T1. In the alternative, the first TFT T1 remains at off state during an off-time period when a voltage in the row line RL1 to RLn is below the threshold voltage Vth of the TFT T1. A data voltage Vc1 from the column line CL is applied to the gate terminal of the second TFT T2 through the first TFT T1 during the on-time period of the first TFT T1. However, the current path between the source terminal and the drain terminal of the first TFT T1 is blocked during the off-time period of the first TFT T1 such that the data voltage Vc1 is not applied to the second TFT T2.

The second TFT T2 controls the current between the source terminal and the drain terminal in accordance to the data voltage Vcl applied to its gate terminal. Accordingly, the electro luminescence cell OLED is made to emit light with a brightness corresponding to the data voltage Vc1. The capacitor Cst stores a voltage difference between the data voltage Vc1 and a cell drive voltage VDD to sustain the voltage applied to the gate terminal of the second TFT T2 for one frame period to uniformly sustain the current applied to the electro luminescence cell OLED for one frame period.

The aging circuit 44 includes a first to a third aging AC voltage sources Va1 to Va3 that are being switched between 0 volt and a specific negative voltage, which is different for each aging AC voltage source. A first aging switch device A1 is connected between the first aging AC voltage source Va1 and the gate terminal of the first TFT T1. A second aging switch device A2 is connected between the second aging AC voltage source Va2 and the source terminal of the first TFT T1. A third aging AC voltage source Va3 is connected to turn on the first and second aging switch devices A1 and A2.

The aging circuit 44 applies an aging voltage to the electro luminescence cell OLED, wherein the final aging voltage is a drive voltage from the cell drive voltage source VDD. The cell drive voltage source VDD together with a voltage VSS applied to the cathode terminal of the current electro luminescence cell OLED applies a voltage across the electro luminescence cell OLED, which is lower than a cell drive voltage VDD of the related art. Accordingly, same aging voltages can be applied to the electro luminescence cell OLED, and the first to third aging AC voltage sources Va1 to Va3 can also be reduced by the voltage applied to the cathode terminal of the electro luminescence cell OLED as compared with the aging voltage source of the related art.

Figure 7:
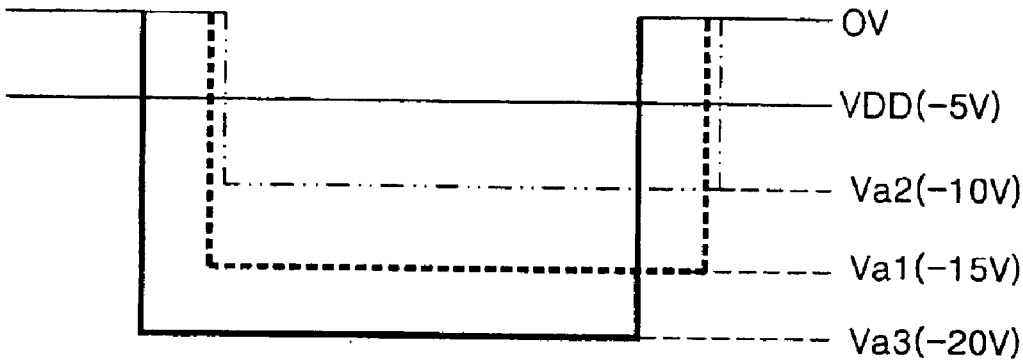
FIG. 7 is a drive waveform diagram of the aging circuit shown in FIG. 6.

FIG. 7 represents an example of an aging AC voltage waveform applied to an aging circuit shown in FIG. 6. As shown in FIG. 7, an AC square pulse voltage is applied from the first to third aging AC voltage sources Va1 to Va3. The first aging AC voltage source Va1 applies −15V, the second aging AC voltage source Va2 applies −10V, and the third aging AC voltage source Va3 applies −20V. Further, a cell drive voltage VDD connected to the second TFT T2 applies −5V, and a cell support voltage source VSS connected to the cathode terminal of the electro luminescence cell OLED applies +10V. The second aging AC voltage Va2 is stored at the capacitor Cst of the pixel 42 when the first to third aging AC voltages are applied to to turn on the first and second aging switch devices A1 and A2 and the first TFT T1. More specifically, the third aging AC voltage Va3 is first applied to turn on the first and second aging switch device A1 and A2. When the first and second aging switch devices A1 and A2 are turned on, the first and second aging AC voltages Va1 and Va2 are almost simultaneously applied to turn on the first TFT T1. When the first TFT T1 is turned on, the second aging AC voltage Va2 charges the capacitor Cst after passing through the second aging switch device A2 and the first TFT T1.

After the AC square pulse voltage is applied, such as when the first to third aging AC voltage source Va1 to Va3 go to 0V, the first and second aging switch devices A1 and A2 and the first TFT T1 are turned off. However, the data voltage charged in the capacitor Cst remains applied to the gate terminal of the second TFT T2 such that the second TFT T2 remains at on state. The second TFT T2 controls a current path between the source terminal and the drain terminal by the charged voltage in the capacitor Cst that is applied to the gate terminal of itself, thereby causing the electro luminescence cell OLED to emit light with a brightness corresponding to the charged voltage of the capacitor Cst.

While being driven as described above, the electro luminescence cell OLED is supplied with an aging voltage regardless of the on/off state of the first and second aging switch device A1 and A2 and the first TFT T1. Due to this, the on-time of the first and second aging switch devices A1 and A2 and the first TFT T1, such as the length of time that the aging voltage is applied, can be reduced to thereby reduce the voltage stress on the TFTs within the pixel.

Figure 8:
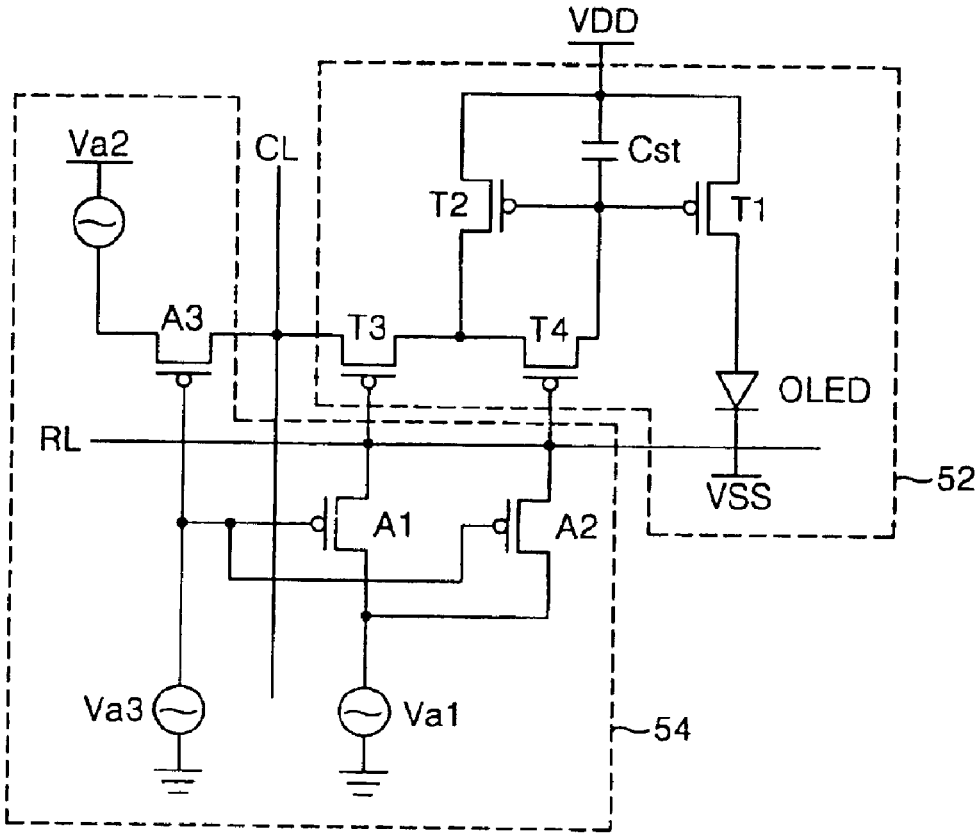
FIG. 8 is a diagram representing an aging circuit for an organic electro luminescence device according to a second embodiment of the present invention.

FIG. 8 is a diagram representing an aging circuit for an organic electro luminescence device according to the second embodiment of the present invention. As shown in FIG. 8, the organic electro luminescence device includes a number m of column lines CL1 to CLm, a number n of row lines RL1 to RLn to cross the column lines CL1 to CLm, a number m×n of pixels 52 arranged in a matrix at intersection parts, and an aging circuit 54 enabling the size of voltage and a voltage application time to vary, so that aging can be implemented correctly and effectively for improving all characteristics of the organic electro luminescence device, such as the brightness of organic electro luminescence cell OLED and to prevent deterioration of switching devices.

Each pixel 52 includes a first TFT T1 formed between a cell drive voltage source VDD and an electro luminescence cell OLED for driving the electro luminescence cell OLED; a second TFT T2 connected to the cell drive voltage source VDD to form a current mirror with the first TFT T1; a third TFT T3 connected to the column line CL and the row line RL for responding to a signal in the row line; a fourth TFT T4 connected to the gate terminal of the second TFT T2, the row line RL and the third TFT T3; and a capacitor Cst connected between the gate terminals of the first and second TFTs T1 and T2 and a voltage supply line VDD. The first to fourth TFT's T1 to T4 are p-type MOS-FET's. The cathode terminal of the electro luminescence cell OLED is supplied with a cell support voltage VSS that has a specific voltage difference with respect to a cell drive voltage VDD. The voltage difference between the cell drive voltage VDD and the cell support voltage VSS is the same as the voltage difference between the cell drive voltage VDD and the ground voltage GND shown in the related art in FIG. 3.

The third and fourth TFT's T3 and T4 are turned on in response to a negative scan voltage from the row line RL1 to RLn. Thus a current path is enabled to conduct current between the source terminal and the drain terminal of each of the third and fourth TFT's T3 and T4 during an on-time period. The third and fourth TFT's T3 and T4 remain at off state when a voltage in the row line RL1 to RLn is below the threshold voltage Vth of the third and fourth TFT's T3 and T4. A data voltage Vc1 from the column line CL is applied to the gate terminal of the first TFT T1 through the third and fourth TFT's T3 and T4 during the on-time period of the third and fourth TFT's T3 and T4. However, the current path between the source terminal and the drain terminal of each of the third and fourth TFT's T3 and T4 is blocked for the data voltage Vcl during an off-time period of the third and fourth TFT's T3 and T4.

The first TFT T1 controls the current between the source terminal and the drain terminal in accordance with the data voltage Vc1 applied to the gate terminal of itself, so the electro luminescence cell OLED is made to emit light with a brightness corresponding to the data voltage Vc1. The second TFT T2 is configured to form a current mirror with the first TFT T1, thereby uniformly controlling current at the first TFT T1. The capacitor Cst stores a voltage difference between the data voltage Vc1 and a cell drive voltage VDD to sustain the voltage applied to the gate terminal of the first TFT T1 for one frame period, and to uniformly sustain the current applied to the electro luminescence cell OLED for one frame period.

The aging circuit 54 includes a first to a third aging AC voltage sources Va1 to Va3 that are being switched between 0 volt and a specific negative voltage, which is different for each aging AC voltage source. The first aging switch device A1 is connected between the first aging AC voltage source Va1 and the gate terminal of the third TFT T3. A second aging switch device A2 is connected between the first aging AC voltage source Va1 and the gate terminal of the fourth TFT T4. A third aging AC voltage source Va3 is commonly connected to each gate terminal of the first to third aging switch devices A1 to A3 for turning on the first to third aging switch devices A1 to A3.

The aging circuit 54 applies an aging voltage to the electro luminescence cell OLED, wherein the final aging voltage is a drive voltage from the cell drive voltage source VDD. At this moment, the cell drive voltage source VDD applies a voltage, which is lower than a cell drive voltage VDD of the related art by a voltage applied to the cathode terminal of the current electro luminescence cell OLED. Thus, the same aging voltages can be applied to the electro luminescence cell OLED, and the first to third aging AC voltage sources Va1 to Va3 can also be reduced by the voltage applied to the cathode terminal of the electro luminescence cell OLED as compared with the aging voltage source of the related art. In this case, the supply voltages applied through the cell drive voltage source VDD, the cell support voltage source VSS and each aging voltage source Va are the same as the drive waveforms shown in FIG. 7.

Figure 9:
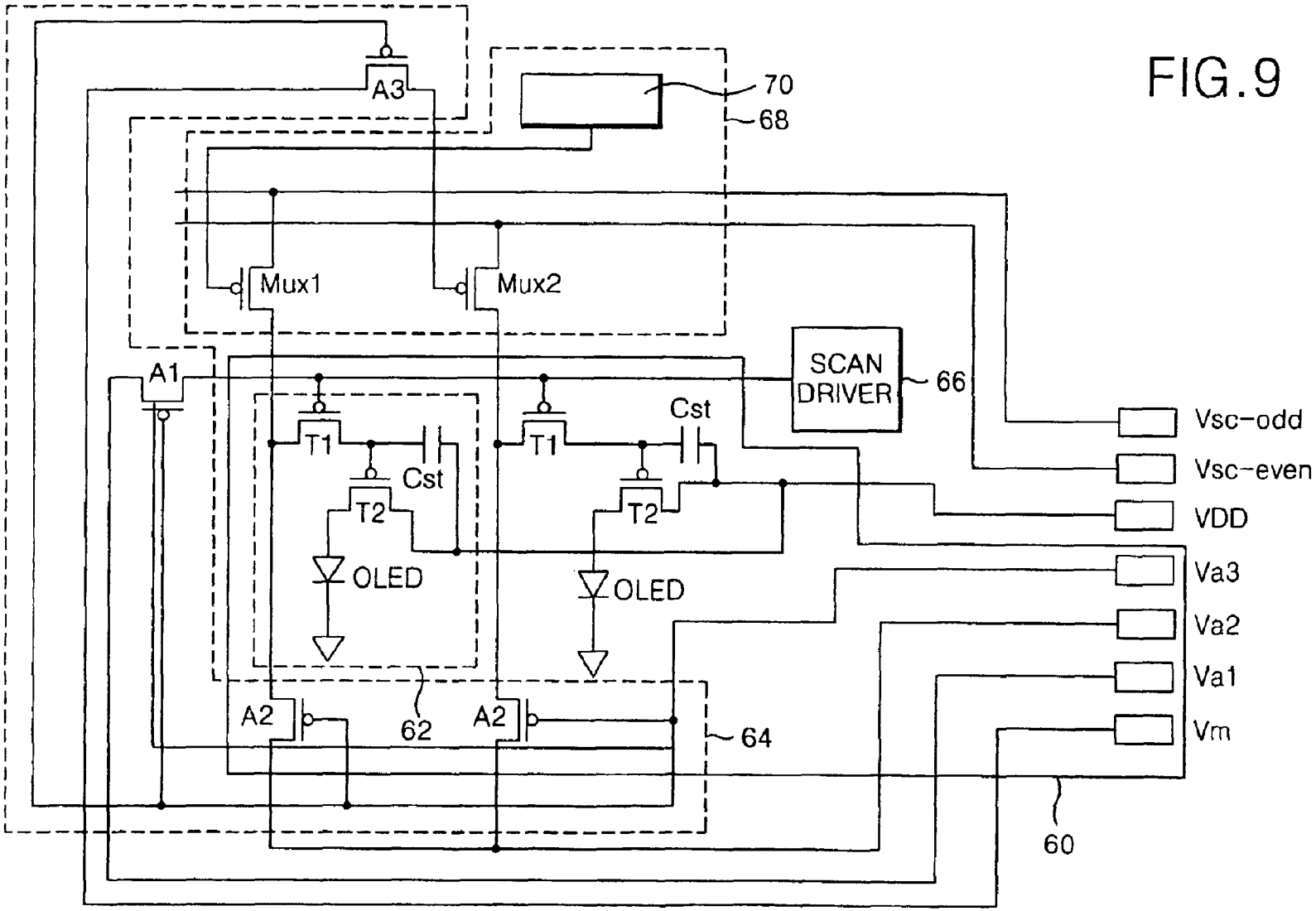
FIG. 9 is a detailed diagram representing an organic electro luminescence display device including the aging circuit shown in FIG. 6.

FIG. 9 is a detailed diagram representing an organic electro luminescence display device including an aging circuit shown in FIG. 6. As shown in FIG. 9, the organic electro luminescence display device including the aging circuit according to the present embodiment includes an organic electro luminescence display panel 60 having an organic pixel cell 62 arranged at each intersection part of column lines CL1 to CLm and row lines RL1 to RLn, a scan driver 66 to drive the row lines RL1 to RLn, and a data driver 68 to drive the column lines CL1 to CLm. The scan driver 66 sequentially applies a negative scan pulses to the row lines RL1 to RLn. The data driver 68 includes a data drive integrated circuit IC 70 to apply a current signal to the column lines CL, wherein the current signal has a current level or pulse width corresponding to a data signal for each horizontal period; a multiplexor Mux connected between the data drive IC 70 and each column line CL for causing a data voltage not to be applied to the column line CL during an aging period.

The organic electro luminescence display device applies a current signal that has a current level or pulse width in proportion to an input data, to pixels 62. And, each pixel 62 emits light in proportion to the amount of current applied from the column electrode line CL. Each pixel 62 includes a first TFT T1 acting as a switching device formed at each intersection part of the column lines CL1 to CLm and the row lines RL1 to RLn, a second TFT T2 formed between a cell drive voltage source VDD and an electro luminescence cell OLED for driving the electro luminescence cell OLED, and a capacitor Cst connected between the first and second TFT T1 and T2. The first and second TFT's T1 and T2 are p-type MOS-FET's. The cathode terminal of the electro luminescence cell OLED is supplied with a cell support voltage VSS that has a specific voltage difference with a cell drive voltage VDD. The voltage difference between the cell drive voltage VDD and the cell support voltage VSS is the same as the voltage difference between the cell drive voltage VDD and the ground voltage GND shown in FIG. 3.

The first TFT T1 is turned on in response to a negative scan voltage from the row line RL1 to RLn, thus a current path is enabled to conduct current between the source terminal and the drain terminal of the first TFT T1. The first TFT T1 remains at off state when a voltage in the row line RL1 to RLn is below the threshold voltage Vth of first TFT T1. A data voltage Vc1 from the column line CL is applied to the gate terminal of the second TFT T2 through the first TFT T1 during the on-time period of the first TFT T1. On the contrary, the current path between the source terminal and the drain terminal of the first TFT T1 is blocked and the data voltage Vc1 is not to be applied to the second TFT T2 during the off-time period of the first TFT T1.

The second TFT T2 controls the current between the source terminal and the drain terminal by the data voltage Vc1 applied to the gate terminal of itself, so the electro luminescence cell OLED is made to emit light with a brightness corresponding to the data voltage Vc1.

The capacitor Cst stores a voltage difference between the data voltage Vc1 and a cell drive voltage VDD to sustain the voltage applied to the gate terminal of the second TFT T2 for one frame period, and to uniformly sustain the current applied to the electro luminescence cell OLED for one frame period.

The aging circuit 64 includes first and second aging voltage pads Va1 and Va2 to input an aging AC voltage Va switched between 0 volt and a specific negative voltage, which is different for Va1 and Va2; a first aging switch device A1 connected between the first aging voltage pad Va1 and the gate terminal of the first TFT T1; a second aging switch device A2 connected between the second aging voltage pad Va2 and the source terminal of the first TFT T1; and a third aging voltage pad Va3 to turn on the first and second aging switch devices A1 and A2. Further, the aging circuit 64 includes a fourth aging voltage pad Vm to turn on age a multiplexor with the data driver 68.

When driving the organic electro luminescence display device in such a manner described previously, deterioration can be prevented while applying same aging voltage to each TFT and the electro luminescence cell OLED. Further, it is possible to age another desired switch device within the organic electro luminescence display device. As described above, the aging circuit for the organic electro luminescence device and the driving method thereof according to the present invention uses alternate current voltage to apply a specific constant voltage to the cathode terminal of the electro luminescence cell OLED. Accordingly, the aging circuit for the organic electro luminescence device and the driving method thereof according to the present invention can reduce aging voltage and aging time, and the aging voltage is applied for aging the switch device and electro luminescence cell with the pixel. Therefore, the life span of the switch device and the organic electro luminescence cell can be extended.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An aging circuit for an organic electro luminescence device, comprising:

a plurality of pixels arranged in a matrix at intersection areas of row lines and column lines;

an organic electro luminescence cell formed at a pixel area between the column lines and the row lines;

a first switch device formed at the intersection area of the column line and the row line for acting as a switch;

a second switch device formed between a cell drive voltage source and the electro luminescence cell for driving the electro luminescence cell;

a capacitor connected between the first switch device and the second switch device, wherein a cathode terminal of the electro luminescence cell is connected to a cell support voltage source of a positive voltage; and an aging circuit having at least one aging AC voltage source for applying a specific aging AC voltage pulse to the pixels.

2. The aging circuit according to claim 1, further comprising:

first and second aging AC voltage sources that are switched between 0V and a specific negative voltage, the specific negative voltage is different for each aging AC voltage source;

a first aging switch device connected between the first aging AC voltage source and a gate terminal of the first switch device;

a second aging switch device connected between the second aging AC voltage source and a source terminal of the first switch device; and a third aging AC voltage source for turning on the first and second aging switch devices.

3. The aging circuit according to claim 2, wherein a supply voltage difference between the cell drive voltage source and the cell support voltage source is −15V.

4. The aging circuit according to claim 3, wherein a supply voltage of the cell drive voltage source is −5V, and a supply voltage of the cell support voltage source is +10V.

5. The aging circuit according to claim 4, wherein the first to third aging AC voltage sources are applied with an AC voltage pulse, and there is a relationship of the cell drive voltage source>the second aging AC voltage source>the first aging AC voltage source>the third aging AC voltage source with respect to the supply voltage.

6. The aging circuit according to claim 5, wherein a supply voltage of the second aging AC voltage source is −10 V, a supply voltage of the first aging AC voltage source is −15V and a supply voltage of the third aging AC voltage source is −20V.

7. An aging circuit for an organic electro luminescence device, comprising:

an organic electro luminescence cell formed at a pixel area between the column lines and the row lines;

a first switch device formed between a cell drive voltage source and the electro luminescence cell for driving the electro luminescence cell;

a second switch device connected to the cell drive voltage source to form a current mirror with the first switch device;

a third switch device connected to the second switch device, the column line and the row line for responding to a signal in the row line;

a fourth switch device connected between the third switch device and gate terminals of the first and second switch devices;

a capacitor connected between the cell drive voltage source and the gate terminals of the first and second switch devices, wherein a cathode terminal of the electro luminescence cell is connected to a cell support voltage source of a positive voltage; and an aging circuit having at least one aging AC voltage source for applying a specific aging AC voltage pulse to the pixels.

8. The aging circuit according to claim 7, further comprising:

first and second aging AC voltage source that are switched between 0V and a specific negative voltage, the specific negative voltage is different for each aging AC voltage source;

a first aging switch device connected between the first aging AC voltage source and a gate terminal of the third switch device;

a second aging switch device connected between the first aging AC voltage source and a gate terminal of the fourth switch device;

a third aging switch device connected between the second aging AC voltage source and a source terminal of the third switch device; and a third aging AC voltage source for turning on the first to third aging switch devices.

9. The aging circuit according to claim 8, wherein a supply voltage difference between the cell drive voltage source and the cell support voltage source is −15V.

10. The aging circuit according to claim 9, wherein a supply voltage of the cell drive voltage source is −5V, and a supply voltage of the cell support voltage source is −10V.

11. The aging circuit according to claim 10, wherein the first to third aging AC voltage source are applied in an AC voltage pulse, and there is a relationship of the cell drive voltage source>the second aging AC voltage source>the first aging AC voltage source>the third aging AC voltage source with respect to the supply voltage.

12. The aging circuit according to claim 11, wherein a supply voltage of the second aging AC voltage source is −10, a supply voltage of the first aging AC voltage source is −15V and a supply voltage of the third aging AC voltage source is −20V.

13. A driving method of an aging circuit for an organic electro luminescence device, wherein the aging circuit applies a specific aging voltage to pixels of the organic electro luminescence device, comprising:

applying a plurality of aging AC voltages to the pixels, the aging AC voltage is applied in an AC voltage pulse; and causing an electro luminescence cell within the pixel to emit light by the aging AC voltage in accordance with a current corresponding to a current path formed, wherein the electro luminescence cell emits light in accordance with a voltage difference between a cell support voltage source and a cell drive voltage source corresponding to the current path.

14. The driving method according to claim 13, wherein the cell drive voltage source applies a negative voltage and a supply voltage difference between the cell drive voltage source and the cell support voltage source is −15V.

15. The driving method according to claim 13, wherein the aging AC voltage sources apply a voltage lower than the cell drive voltage source applies.

16. An aging circuit for organic electro luminescence device having an organic electro luminescence cell formed at a pixel area between the column lines and the row lines, the aging circuit comprising;

at least one aging AC voltage source for applying a specific aging AC voltage pulse to the pixels;

a second aging AC voltage sources that are switched between 0V and a specific negative voltage, the specific negative voltage is different for each aging AC voltage source; and a third aging AC voltage source for turning on the first and second aging switch devices.

* * * * *